US008728294B2

(12) United States Patent
Yamamoto et al.

(10) Patent No.: US 8,728,294 B2
(45) Date of Patent: May 20, 2014

(54) ANODIZING METHOD AND APPARATUS

(75) Inventors: Tomoharu Yamamoto, Shizuoka-Ken (JP); Hiroomi Tanaka, Shizuoka-Ken (JP); Masahiro Fujita, Shizuoka-Ken (JP)

(73) Assignee: Suzuki Motor Corporation (JP)

( * ) Notice: Subject to any disclaimer, the term of this patent is extended or adjusted under 35 U.S.C. 154(b) by 213 days.

(21) Appl. No.: 12/403,577

(22) Filed: Mar. 13, 2009

(65) Prior Publication Data

US 2009/0236228 A1 Sep. 24, 2009

(30) Foreign Application Priority Data

Mar. 24, 2008 (JP) ..... 2008-075683

(51) Int. Cl.
*C25D 11/02* (2006.01)
*C25D 21/12* (2006.01)
*C25D 11/04* (2006.01)

(52) U.S. Cl.
USPC ..... 205/107; 205/83; 205/324

(58) Field of Classification Search
USPC ..... 204/230.6, 228.1–229.3, 229.8; 205/106–108, 324–332, 83
See application file for complete search history.

(56) References Cited

U.S. PATENT DOCUMENTS 4,571,287 A * 2/1986 Okubo et al. ..... 205/107
4,798,656 A * 1/1989 Paulet ..... 205/105
6,726,825 B2 * 4/2004 Yoshimura et al. ..... 205/83
8,187,432 B2 * 5/2012 Yamamoto et al. ..... 204/242
2006/0037866 A1 * 2/2006 Yamamoto et al. ..... 205/324
2008/0087551 A1 * 4/2008 Odajima et al. ..... 205/324

FOREIGN PATENT DOCUMENTS

| | | |
|---|---|---|
| JP | 49-23978 | 6/1974 |
| JP | 57-169099 | 10/1982 |
| JP | 62-253797 | 11/1987 |
| JP | 04-198497 | 7/1992 |
| JP | 06-167243 | 6/1994 |
| JP | 2006-083467 | 3/2006 |

* cited by examiner

*Primary Examiner* — Nicholas A Smith
*Assistant Examiner* — Brian W Cohen
(74) *Attorney, Agent, or Firm* — Lerner, David, Littenberg, Krumholz & Mentlik, LLP

(57) ABSTRACT

An anodizing method in which a workpiece made of aluminum or aluminum alloy is immersed in an electrolytic solution, and treatment is performed in which the application of positive voltage for a very short period of time and the removal of charges are repeated alternately between the workpiece and a cathode arranged in the electrolytic solution includes a step of performing treatment in which the positive voltage application and the charge removal are repeated in a tentative cycle, measuring the control point arrival time of a current waveform at the positive voltage application period, and determining normal positive voltage application time based on the control point arrival time; and a step of performing treatment in which the application of positive voltage and the removal of charges are repeated in a cycle corresponding to the normal positive voltage application time, and forming an anodized film on the surface of the workpiece.

6 Claims, 8 Drawing Sheets

PERIOD 1000μs、T=480μs、duty=96%

T/tc= 16

PERIOD 200μs、T=80μs、duty=80%

T/tc= 2.7

PERIOD 143 μs、T=51 μs、duty=71%

T/tc= 1.7

PERIOD 100 μs、T=30 μs、duty=60%

T/tc= 1.0

ANODIZING METHOD AND APPARATUS

CROSS-REFERENCE TO RELATED APPLICATIONS

The present application claims priority from Japanese Application No. 2008-075683, filed Mar. 24, 2008, the disclosure of which is incorporated herein by reference.

FIELD OF THE INVENTION

The present invention relates to a method for anodizing a workpiece made of aluminum or aluminum alloy and to an apparatus for carrying out the method.

BACKGROUND OF THE INVENTION

Conventionally, members made of aluminum or aluminum alloy, such as a variety of exterior parts and structural parts including pistons and cylinders of internal combustion engines and hydraulic-pneumatic pistons and cylinders, have been anodized to form an anodized film (alumite) on the surfaces of the members for the purpose of improving corrosion resistance and wear resistance or coloring.

For this anodizing treatment, DC anodizing treatment, in which electrolyzing treatment is performed by applying DC voltage between a workpiece (anode) and a cathode in the state in which the workpiece is immersed in an electrolytic solution, has been primarily used. In the DC anodizing treatment, treatment is generally performed at a current up to about 3 A per 1 $dm^2$ of the surface area of the workpiece to prevent burning.

In such treatment, a film thickness formed per unit time, that is, a film growth rate, is generally low: for example, the film growth rate is not higher than 1.0 μm/min for an expanded material or an AC material, and is not higher than 0.5 μm/min for an ADC material containing 7.5% or more Si. Therefore, depending on the number of workpieces, a time of 20 to 40 minutes has been required for one cycle of treatment. Also, due to the influence of a contained alloy component, a defect is liable to be produced in the film, and there also arises a problem of occurrence of corrosion in the defective part.

In JP 04-198497 A, in addition to current control, the electrolytic solution is concentrated in a portion of the workpiece by means of masking using a special jig to accomplish forced convection and forced cooling, by which a film growth rate of 13 μm/min is realized for an AC material while the burning and melting of film are restrained. However, it is difficult to apply this technique to large parts and intricately shaped parts.

For the above-described DC anodizing treatment, an attempt has been made to perform anodizing by applying AC voltage or superimposed voltage of DC and AC to between the workpiece and the cathode (refer to JP 06-167243 A, JP 57-169099 A, JP 49-023978 B, and JP 62-253797 A). All of these Publications describe only examples at a commercial frequency level. In the electrolyzing treatment in such a low frequency region, the current density is low, and the treatment speed and the treatment quality are not improved greatly.

The present inventors discovered a treatment method for forming a high-quality anodized film at a high speed without being affected by the alloy component by repeating the application of positive voltage for a very short period of time and the removal of charges alternately as disclosed in JP 2006-83467 A. In this method, since the temperature rise is restrained by the removal of charges, film growth rates of 7.5 μm/min for an AC material, 4 μm/min or higher for an ADC material containing 7.5% or more Si, and 2 μm/min or higher for a casting surface are realized, and also, reduction in film defects is achieved.

SUMMARY OF THE INVENTION

As described above, in the anodizing treatment, the treatment method in which the application of positive voltage for a very short period of time by means of a high-frequency pulse voltage and the removal of charges are repeated alternately has many advantages. However, in the actual treatment process, in a case in which many parts are treated at the same time or in a case in which large parts are treated, to secure the film growth rate, a high voltage proportional to the increase in treatment surface area must be applied, and therefore the load on a power supply unit increases.

Therefore, it is important that in the range of voltage and frequency allowed by the power supply unit, an optimum and necessary minimum voltage and frequency according to the treatment surface area be determined while the treatment speed and treatment quality are maintained. Even if the voltage and frequency are increased unreasonably, the load on the power supply unit increases, and also the treatment quality may be rather degraded. However, even if a tentative treatment condition can be determined experimentally in a limited treatment environment, there has been no evaluation reference and method capable of determining the optimum treatment condition qualitatively without depending on the shape of workpiece and number of workpieces to be treated.

The present invention has been made in view of the above circumstances, and accordingly, an object thereof is to provide an anodizing method and an apparatus in which in the anodizing treatment performed by repeating the application of positive voltage for a very short period of time and the removal of charges alternately, the positive voltage application time and pulse frequency that are best suitable for the workpiece can be set qualitatively without depending on the shape of workpiece and number of workpieces to be treated, and the treatment speed and treatment quality can be improved.

To solve the above-described problems, as the result of extensive research, the present inventors found experimentally that in the anodizing treatment performed by repeating the application of positive voltage for a very short time and the removal of charges, although the current flowing in the anodized film increases suddenly immediately after the application of positive voltage, the current conversely decreases in a short period of time, and after a certain time has elapsed, only a very small amount of current flows. The present inventors discovered that the optimum treatment condition can be determined qualitatively without depending on the shape of workpiece and number of workpieces to be treated, and arrived at the present invention.

The present invention provides an anodizing method in which a workpiece made of aluminum or aluminum alloy is immersed in an electrolytic solution, and treatment is performed in which the application of positive voltage for a very short period of time and the removal of charges are repeated alternately between the workpiece and a cathode arranged in the electrolytic solution, including: a step of performing treatment in which the application of positive voltage and the removal of charges are repeated in a tentative cycle, measuring the control point arrival time of a current wave format the positive voltage application period, and determining normal positive voltage application time based on the control point arrival time; and a step of performing treatment in which the application of positive voltage and the removal of charges are repeated in a cycle corresponding to the normal positive voltage application time, and forming an anodized film on the surface of the workpiece.

In the anodizing treatment in which the application of positive voltage for a very short period of time and the removal of charges are repeated alternately between the workpiece and the cathode, the anodized film is formed for the positive voltage application period only. However, it has been already known that by once removing electric charges accumulated in the film by negative voltage application or short circuit at the charge removal period, the anodized film can further be formed at the positive voltage application period, so that large amounts of electric charges per unit time as compared with the case of DC anodization can be caused to contribute to anodization.

However, even for the positive voltage application period, a significant current flows in the anodized film for a certain period only immediately after the application of positive voltage. In a short period of time, the peak is reached, and then the current begins to decrease. After a certain time has elapsed, only a very small amounts of current flows. The fact that the current reaches the peak after the application of positive voltage indicates that the resistance of the film is low before the peak is reached, and the resistance of the film increases suddenly after the peak is reached.

The reason for this is thought to be that there are a process in which anions in the electrolytic solution penetrate into the barrier layer of the anodized film by means of positive voltage application, and therefore a current flows, by which the oxidation of a base material of aluminum proceeds, and a process in which the anions are accumulated in the barrier layer and new anions are hindered from entering the barrier layer, and therefore the resistance is increased, by which the current is made less liable to flow. Conversely, it is thought that at the time of charge removal, the anions penetrating in the barrier layer is released to the electrolytic solution, by which a current is caused to flow, and when the release is finished, the current becomes less liable to flow.

Therefore, if the positive voltage application period is limited to a period for which the significant current flows in the anodized film, that is, if the application of positive voltage is discontinued within a period for which the significant current flows in the anodized film, and the process is shifted to the charge removal period rapidly, the treatment can be performed in a shorter period of time.

Furthermore, in the anodizing treatment in which the application of positive voltage for a very short period of time and the removal of charges are repeated alternately as described above, it was verified by experiment that the time at which the current reaches the peak after the application of positive voltage depends mainly on the surface area of the workpiece, and is constant even if the applied voltage and the cycle in which the application of positive voltage and the removal of charges are repeated are changed. This fact agrees with the above-described consideration concerning the current, and further preferably, has an advantage that the positive voltage application time best suitable for the workpiece and the cycle corresponding to the positive voltage application time can be set qualitatively without depending on the shape of the workpiece and the number of workpieces to be treated.

In the anodizing treatment, pretreatment in which the application of positive voltage and the removal of charges are repeated alternately in the tentative cycle is performed, and at this time, the current waveform of anode is monitored, and the control point arrival time of current waveform at the positive voltage application period is measured as described below.

FIG. 2 shows a current waveform (A) of the anode in one tentative cycle. In FIG. 2, immediately after the application of a positive voltage pulse indicated by the broken line, the current waveform (A) indicated by the solid line rises suddenly, and a peak (P) is reached. Thereafter, the current decreases somewhat gradually as compared with the rise time, and becomes in a state of being balanced near approximately zero. Then, the positive voltage application is finished, and a negative voltage is applied after an interval, not shown, by which the electric charges accumulated in the anodized film are released.

As a method for detecting a section having an effective amplitude contributing to anodization from the above-described current waveform (A), a threshold value larger than the current value that decreases and reaches the balanced state is set, and time until the threshold value (control point) is reached is measured. For example, it can be thought that the threshold value is set by the ratio to a peak value with the peak value being a reference. Alternatively, the time itself exceeding the threshold value can also be measured.

However, by a further experiment, it was verified that even in the case in which the application of positive voltage stops and the process shifts to the removal of charges after a small interval when the current waveform (A) still has a sufficient amplitude, that is, when the electrolysis current still flows sufficiently, the treatment speed and the treatment quality are improved. Therefore, it is practical to optimize the positive voltage application time based on the peak arrival time (tc) with the peak (P) of current waveform capable of responding to these cases and capable of being detected easily being the control point.

In the present invention, it is preferable that the control point arrival time be the peak arrival time (tc) of current waveform at the positive voltage application period in the tentative cycle, that is, that the control point be the peak of current waveform. In this case, in the step of determining the normal positive voltage application time, it is preferable that the normal positive voltage application time (T) be determined in the range of 0.6 to 3 times the peak arrival time (tc). Also, in the case in which treatment in which priority is given to the treatment speed is performed, it is preferable that the normal positive voltage application time (T) be determined in the range of 1 to 3 times the peak arrival time (tc).

Also, in the case in which treatment in which priority is given to the treatment quality is performed, it is preferable that the normal positive voltage application time be determined in the range of 0.6 to 1.5 times the peak arrival time, and the supplied voltage be increased in the range in which the average current value at the determined normal positive voltage application time does not exceed the maximum average current value.

The maximum average current value was found by determining that in the case in which the positive voltage application time is not shorter than the peak arrival time, that is, in the case in which the peak of current waveform lies within the positive voltage application time, the positive voltage application time at which the average current is made maximum by the property that the current decreases after the peak has been reached exists, and in the case in which the positive voltage application time is finished early before the maximum average current is reached, corresponding electric charges can be supplied in addition within the positive voltage application time.

The above-described maximum average current value can be determined from the actually measured values, but can also be determined by arithmetic processing based on the current waveform. Also, since it has been found by experiment that the current waveform in the case in which the average current value is at the maximum has a shape close to a sinusoidal curve, in the case in which the normal positive voltage application time is determined in the range of 0.6 to 1.5 times the peak arrival time, the supplied voltage can be increased in the range not exceeding the average current value at the positive voltage application time of two times the peak arrival time.

Furthermore, in the present invention, a step may be performed in which slow-up treatment for increasing a positive voltage from the positive voltage at the time of treatment start, which is lower than a set positive voltage, to the set positive voltage, continuously or stepwise, is performed before the anodizing treatment using the set positive voltage, and the normal positive voltage application time is determined during the slow-up treatment. At this time, it is preferable that the anodizing method further include treatment for predicting peak arrival time in the state in which the voltage is increased to the set positive voltage from the peak arrival time measured during the slow-up treatment and the positive voltage value at the time of the measurement.

Also, in the present invention, the control point arrival time of current waveform may be a time at which the current value reaches a predetermined threshold value (control point) before or after the peak of current waveform is reached.

Also, to carry out the above-described anodizing method, the present invention provides an anodizing apparatus including a treatment tank (1) for storing an electrolytic solution (10); a cathode (2) arranged in the treatment tank; and an inverter power supply unit (4, 43) capable of sending out a high-frequency pulse voltage by switching a DC power source and of changing the positive voltage application period and charge removal period, in which treatment is performed in which the application of positive voltage for a very short period of time and the removal of charges are repeated alternately between a workpiece (11) made of aluminum or aluminum alloy, immersed in the electrolytic solution, and the cathode, wherein the anodizing apparatus further includes a current supervisory means (44, 54) for monitoring the current of a power transmission line leading from the inverter power supply unit to the workpiece; and a measuring means (53*a*, 54, 51) for measuring control point arrival time at the positive voltage application period of a current waveform obtained by the current supervisory means in synchronization with the switching of the inverter power supply unit, and positive voltage application time can be set or changed based on the control point arrival time.

It is preferable that the control point arrival time be the peak arrival time of the current waveform at the positive voltage application period in the tentative cycle. Also, the control point arrival time of current waveform may be a time at which the current value reaches the predetermined threshold value before or after the peak of current waveform at the positive voltage application period in the tentative cycle is reached.

In the present invention, since the above-described anodizing method is employed, the positive voltage application time and pulse frequency that are most suitable for the workpiece can be set qualitatively without depending on the shape of the workpiece and number of workpieces to be treated, and the treatment speed and treatment quality can be improved. Also, in the range of voltage and frequency allowed by the power supply unit, an optimum and necessary minimum voltage and frequency according to the treatment surface area can be determined while the treatment speed and treatment quality are maintained. Therefore, the load on the power supply unit can be reduced.

In the present invention, if the normal positive voltage application time is determined in the range of 0.6 to 3 times the peak arrival time, and a supplied voltage is increased in the range in which the average current value at the determined normal positive voltage application time does not exceed the average current value at the positive voltage application time that is two times the peak arrival time, the anodizing method is advantageous in increasing the treatment speed while the treatment quality is maintained and in obtaining a thick film.

In the present invention, if the step is performed in which the slow-up treatment for increasing a positive voltage from the positive voltage at the time of treatment start, which is lower than a set positive voltage, to the set positive voltage continuously or stepwise is performed before the anodizing treatment using the set positive voltage, and the normal positive voltage application time is determined during the slow-up treatment, immediately after the slow-up period has elapsed, the process can shift to the anodizing treatment using the normal positive voltage application time, so that the treatment time can be shortened as a whole.

DETAILED DESCRIPTION

An embodiment of the present invention will now be described in detail with reference to the accompanying drawings.

Figure 1:
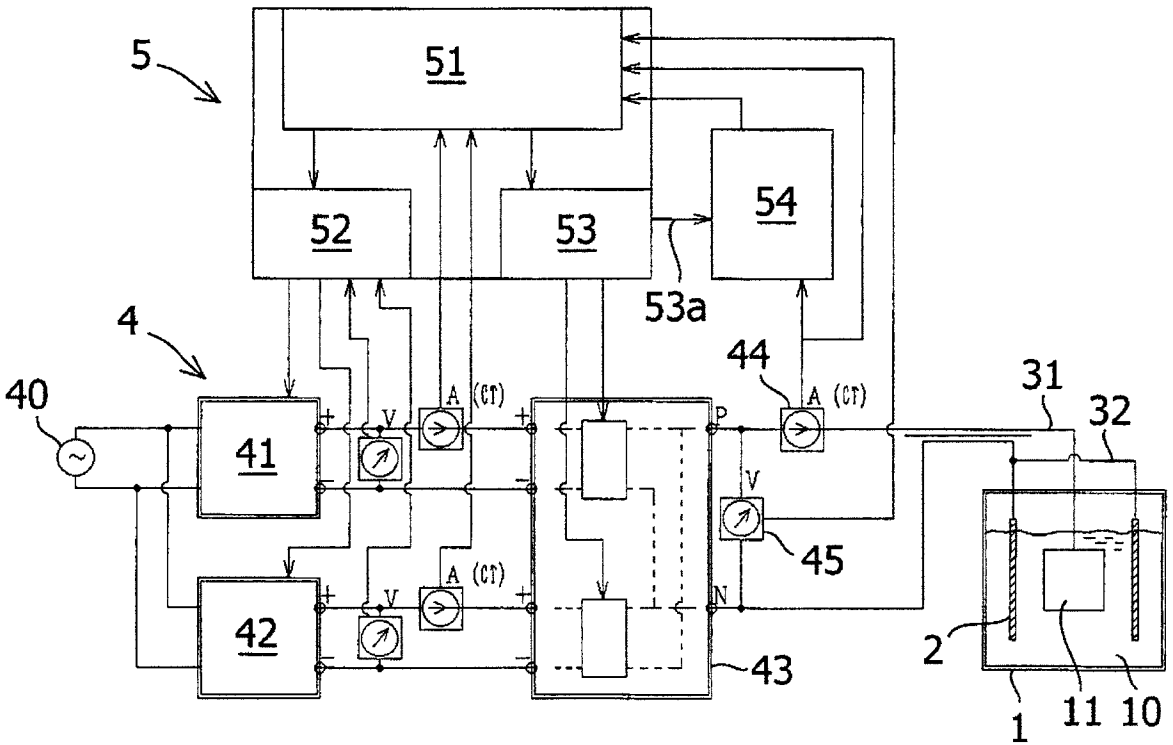
FIG. 1 is a configuration diagram of an anodizing apparatus in accordance with an embodiment of the present invention.

FIG. 1 is a configuration diagram of an anodizing apparatus in accordance with the embodiment of the present invention. In FIG. 1, the anodizing apparatus is mainly made up of a treatment tank 1 for storing an electrolytic solution 10, a cathode plate 2 disposed in the treatment tank 1, a support for supporting a workpiece 11 made of aluminum or aluminum alloy at a position at which the workpiece 11 is immersed in the electrolytic solution 10, a power supply unit 4 for performing treatment in which the application of positive voltage for a very short period of time and the removal of charges are repeated alternately by applying a very short-period bipolar pulse voltage to between the workpiece 11 and the cathode plate 2, and a control unit 5.

The power supply unit 4 includes a DC power supply 41 for positive voltage and a DC power supply 42 for negative voltage, both of which are connected to a primary AC power source 40 of commercial frequency, and an inverter unit 43 for switching the DC voltage and current supplied from the DC power supplies 41 and 42. The inverter unit 43 includes a switching element such as an insulated gate bipolar transistor (IGBT), a clamping circuit, and a protection circuit, and is controlled by a switching control part 53 of the control unit 5.

The control unit 5 includes a main control part 51 for setting parameters of anodization and controlling the anodization, a voltage control part 52 for the DC power supply 41 for positive voltage and the DC power supply 42 for negative voltage, the switching control part 53 for the inverter unit 43, and a supervisory part 54 for a treatment current. The supervisory part 54 monitors the time change in current detected by a current detector 44 provided on the anode side, and can measure required time (control point arrival time) from when the application of positive voltage is started to when the later-described control point of current waveform is reached in synchronization with a trigger signal 53*a* sent from the switching control part 53, and may be configured by a computer capable of executing a program containing these procedures.

As the electrolytic solution 10, dilute sulfuric acid, oxalic acid, phosphoric acid, chromic acid, and the like can be cited. However, the electrolytic solution 10 is not limited to the above-mentioned acids, and an electrolytic solution used for ordinary anodization, such as a diprotic acid bath, a mixed acid bath of diprotic acid and organic acid, or an alkali bath, can be used. The alkali bath may contain a metallic compound of an alkali earth metal. The alkali bath can optionally contain borides or fluorides. Also, the material of the cathode plate 2 is not subject to any special restriction, and an electrode material having been used conventionally for the anodization, such as a carbon plate, titanium plate, stainless steel plate, lead plate, or platinum plate, can be used.

When anodizing treatment is started, supplied voltage, film charge removal voltage, treatment time, slow-up time, and treatment mode are input to the main control part 51 in advance. The slow-up time is time for raising a voltage slowly to a set supplied voltage to prevent an excessive current from flowing in the state in which the anodized film is not yet produced at the early stage of anodization.

As the treatment mode, a high-speed treatment mode in which priority is given to treatment speed, a high-quality treatment mode in which the smoothness of the film surface has priority over treatment speed, an intermediate treatment mode therebetween, and the like can be selected according to the required film properties. The treatment mode is input, for example, by the input of numerical values of percentages or by a selecting switch. By the selection of these treatment modes, the setting reference of the normal positive voltage application time and negative voltage application time (film charge removal time) with respect to the control point arrival time of current waveform is changed.

The optimum positive voltage application time corresponding to each treatment mode differs according to the size and shape of the workpiece 11, the number of workpieces 11 treated at the same time, and the like. Therefore, an anodization test is conducted prior to the treatment, and arithmetic processing is performed by the control unit 5 by measuring the control point arrival time of current waveform by using the supervisory part 54, by which the normal positive voltage application time corresponding to each treatment mode is determined as described below based on the control point arrival time.

In the anodization test, the anodizing treatment in which the application of positive voltage and the removal of charges are repeated alternately in a tentative cycle set empirically is performed, and the arrival time (tc) at which the peak (P) of current waveform, which is the control point appearing ubiquitously in the current waveform during the positive voltage application period, is reached is measured, by which the normal positive voltage application time (T) is determined based on this peak arrival time (tc). Such a condition setting process can also be performed during the slow-up period. The final peak arrival time (tc) may be predicted based on the supplied voltage value at the time when the condition setting process is executed and the final supplied voltage value. This prediction is described later.

Figure 2:
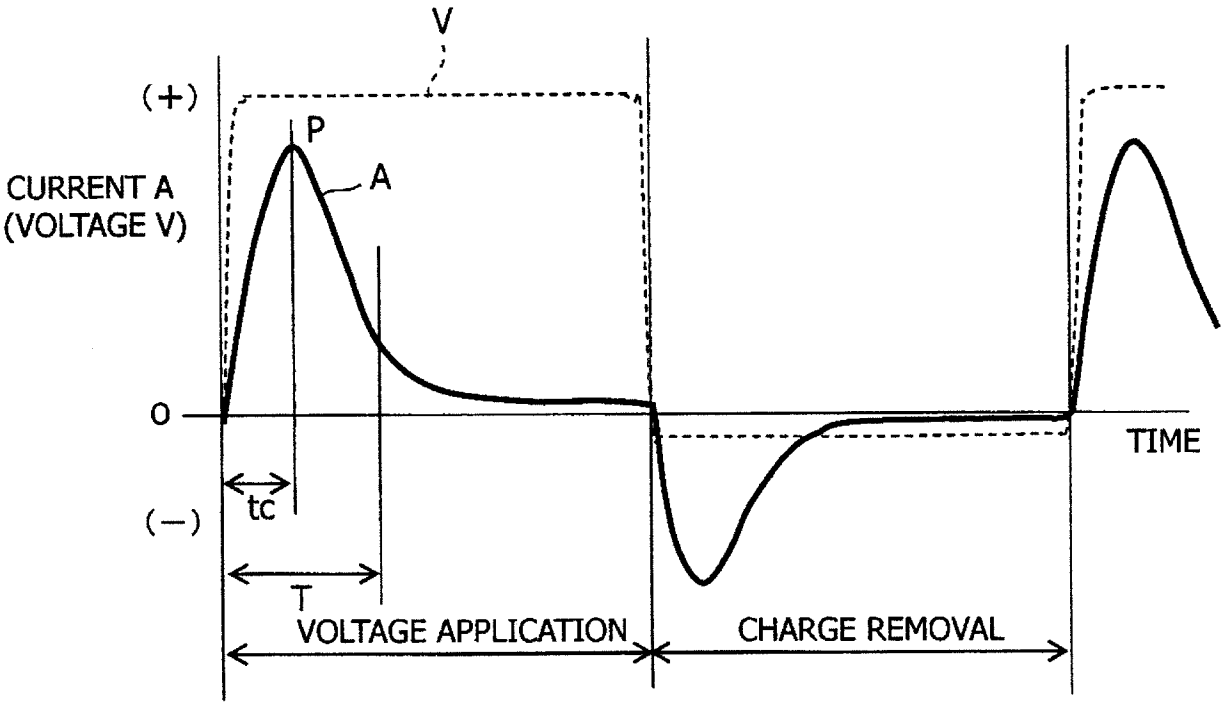
FIG. 2 is a graph showing the current waveform and supplied voltage of an anode in a tentative cycle.

FIG. 2 shows an applied voltage (V) detected by a voltage detector 45 and a current waveform (A) detected by the current detector 44 in the anodizing treatment in which the application of positive voltage and the removal of charges are repeated alternately in the tentative cycle. Immediately after the start of the positive voltage application, a current flows due to the applied voltage (V), and the current waveform (A) rises suddenly. Immediately, however, the peak (P) is reached and the current begins to decrease, and subsequently only a current of low level flows, as previously described. In the conventional DC anodizing treatment, treatment is performed at this low current value. However, by the finish of positive voltage application and the application of negative voltage, the electrified electric charges are removed and a current of a high level is caused to flow again by the application of positive voltage.

A section in which the current waveform (A) has an amplitude at the period of positive voltage application can be said to be a period for which anodization is active. However, since the downward curve of the current waveform (A) is somewhat varied, it is not necessarily easy to extract this period itself. On the other hand, if the same workpieces 11 are treated, even if the positive voltage application time is changed, the peak arrival time (tc) appearing in the current waveform (A) is constant. Therefore, in order to determine proper positive voltage application time (T) from the peak arrival time (tc), the anodizing treatment was performed by changing the positive voltage application time (T) in the range of 0.5 to 5 times the peak arrival time (tc), and an experiment in which the film thickness and film properties were compared in these cases was conducted.

In this experiment, the workpiece 11 formed of an aluminum material (ADC12) was anodized for five minutes by using 10 vol % sulfuric acid as the electrolytic solution and by applying a bipolar pulse voltage of 40 V of supplied voltage (positive voltage) and −2 V of charge removal voltage at a period of 50 to 500 μs (0.5 to 5 times the peak arrival time (tc)) with quiescent time of 20 μs being provided.

Figure 3:
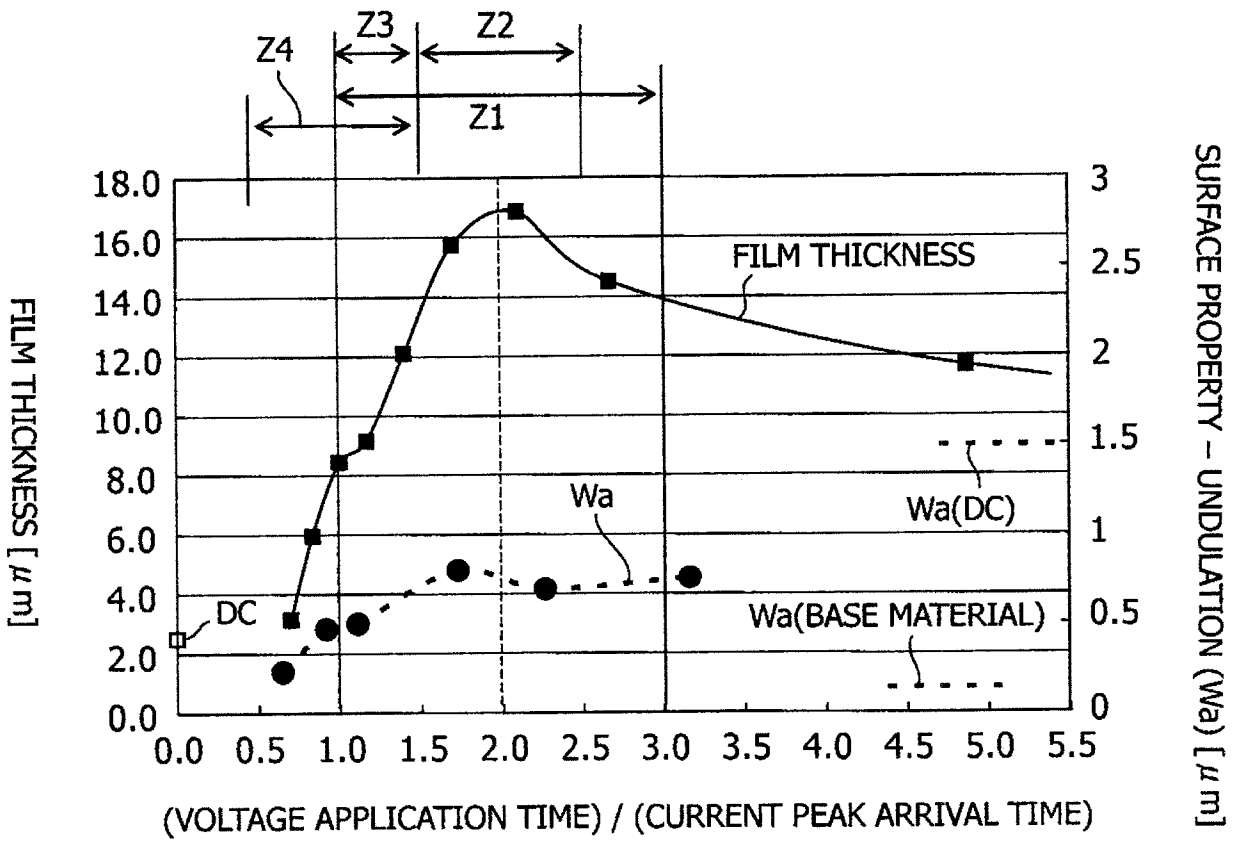
FIG. 3 is a graph showing the relationship between voltage application time/current peak arrival time and film thickness and between voltage application time/current peak arrival time and film undulation.

In the graph of FIG. 3, the abscissas represent a value (T/tc) obtained by dividing the positive voltage application time by the peak arrival time, and the ordinates (left, solid line) represents a film thickness (μm) and the ordinates (right, broken line) represents undulation (Wa) (μm) used as an index of film properties. The undulation (Wa) is an arithmetic mean height of a cross-sectional curve, that is, a value obtained by integrating absolute values with respect to the centerline of the cross-sectional curve in the reference length.

In FIG. 3, the point of 2.0 on the abscissa, at which the thickest film was obtained, indicates the case in which the positive voltage application time (T) is two times the peak arrival time (tc). Therefore, it can be seen that the positive voltage application is finished at a point at which it is two times the peak arrival time (tc), and thereby the period for which anodization is active can be extracted efficiently. The film thickness of this sample reaches 17 μm despite the treatment for five minutes only, so that a film thickness that is six times or more the film thickness of 2.5 μm in the case of the DC anodizing treatment performed for the same treatment time period is attained.

It can be said that a sufficiently thick film is obtained even in the case in which the positive voltage application time (T) is two times or more the peak arrival time (tc). However, it should be noted that the film thickness somewhat decreases. Such positive voltage application for a relatively long period of time does not contribute to the further thickening of the film, but has an advantage of being capable of reducing the load on the power supply unit 4. Moreover, good undulation (Wa) is maintained, being about one-half the undulation (1.5 μm) in the case of the DC anodizing treatment performed under the same conditions. However, for the positive voltage application for a relatively long period of time such as exceeding three times the peak arrival time (tc), the frequency decreases, so that the film forming rate decreases.

On the other hand, in the case in which the positive voltage application time (T) is two times or less the peak arrival time (tc), it can be said that the film thickness decreases approximately in proportion to the positive voltage application time, and additionally the load on the power supply unit 4 increases according to the short period. However, even in the case in which the positive voltage application time (T) is shorter than the peak arrival time (tc), that is, the positive voltage application is finished before the peak of current waveform is reached, a film thickness that is equivalent to or thicker than that obtained by the DC anodizing treatment can still be obtained, and additionally the undulation (Wa) tends to decrease as the positive voltage application time (T) becomes shorter. Therefore, it can be seen that the positive voltage application time shorter than the peak arrival time (tc) is effective in the case in which the treatment quality has priority to the treatment speed.

From the above description, it can be said that if the positive voltage application time (T) is selected in the range of 1 to 3 times (z1) the peak arrival time (tc), a high-quality thick film can be obtained by the short-time anodization treatment. In the case in which the treatment speed or the load on the power supply unit 4 is considered in the selection range, the positive voltage application time in the range of 1.5 to 2.5 times (z2) the peak arrival time (tc) is especially suitable. In the case in which priority is given to the treatment quality, the positive voltage application time in the range of 1.0 to 1.5 times (z3) the peak arrival time (tc) is suitable.

In the case in which the positive voltage application is finished relatively early earlier than the peak arrival time (tc), all of the electric charges capable of being supplied to an anodized layer (aluminum-anodized film interface) are not supplied. In other words, it is suggested that since the electric charges in the anodized layer are not yet saturated, the electric charges can accordingly be applied in addition during a short positive voltage application period.

Figure 4:
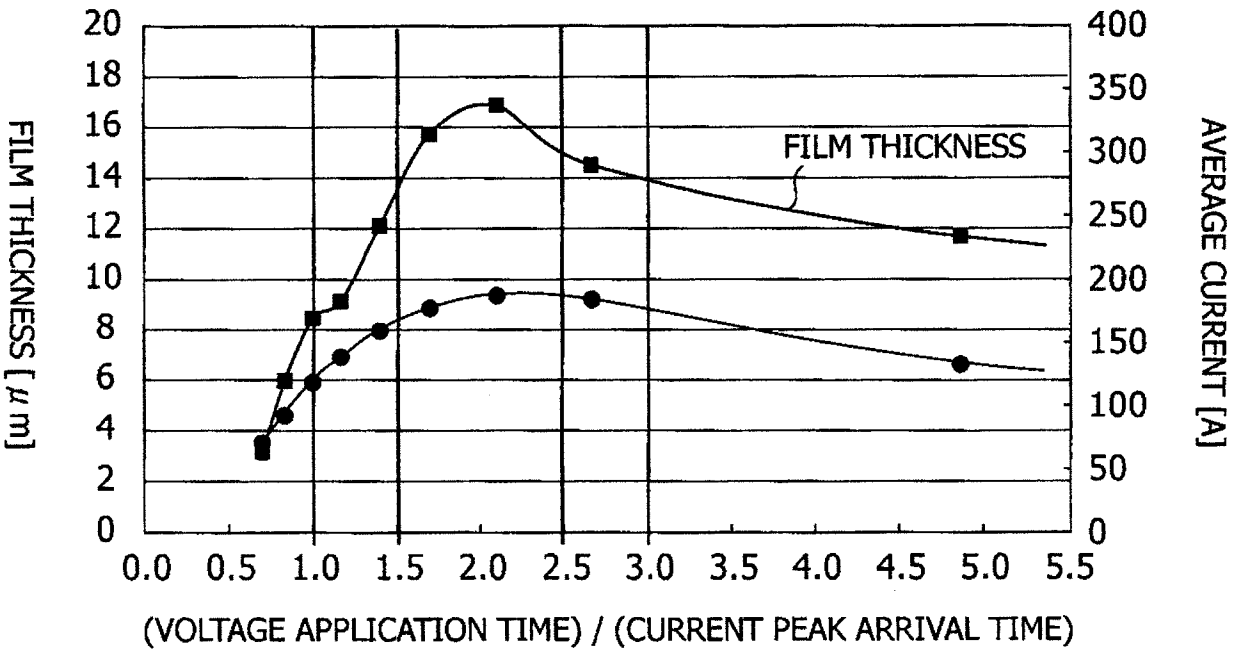
FIG. 4 is a graph showing the relationship between voltage application time/current peak arrival time and film thickness and between voltage application time/current peak arrival time and average current.

FIG. 4 is a graph in which a graph of average current value is added to the graph of FIG. 3. The film thickness and the average current exhibit the same tendency, and in the case in which the positive voltage application time (T) is slightly longer than two times the peak arrival time (tc), the average current at the positive voltage application period of one cycle is at the maximum. That is to say, the product of the maximum average current value and the positive voltage application time can be regarded as the total capacity of electric charges capable of being supplied to the anodized layer at the positive voltage application period of one cycle. Therefore, in the case in which the positive voltage application time (T) is selected in the range of 0.6 to ⅕ times (z4 in FIG. 3) the peak arrival time (tc), it can be said that even if the supplied voltage (positive voltage) is increased in the range in which the average current value during this period of time does not exceed the maximum average current value, the electric charges do not saturate. By an additional experiment, it was verified that a large film thickness can be attained by making a correction to the supplied voltage while good film properties are maintained.

Figure 5:
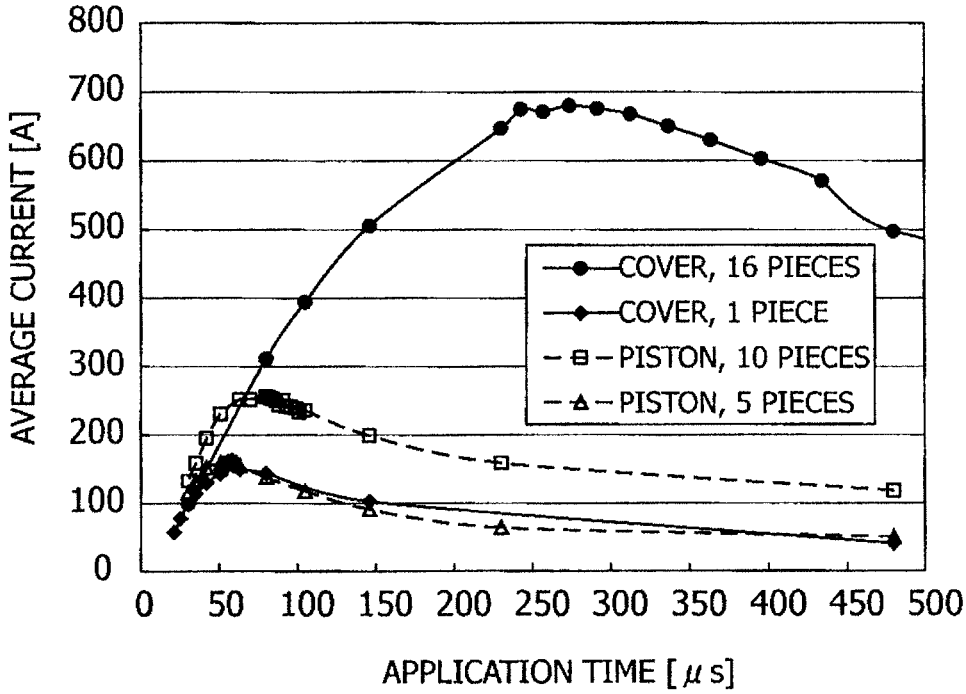
FIG. 5 is a graph showing the relationship between treated surface area and average current.

Next, to examine the relationship between average current and treated surface area, the same anodizing treatment as described above was performed by changing the number of workpieces (pistons and covers of an automotive engine) treated at the same time, and the relationship between positive voltage application time and average current at this time was determined. The result is shown in FIG. 5. The graph of FIG. 5 indicates that as the treated surface area increases, the peak of average current lies in a section in which the positive voltage application time is longer, and more time is required to fill electric charges into the anodized layer.

Figure 6:
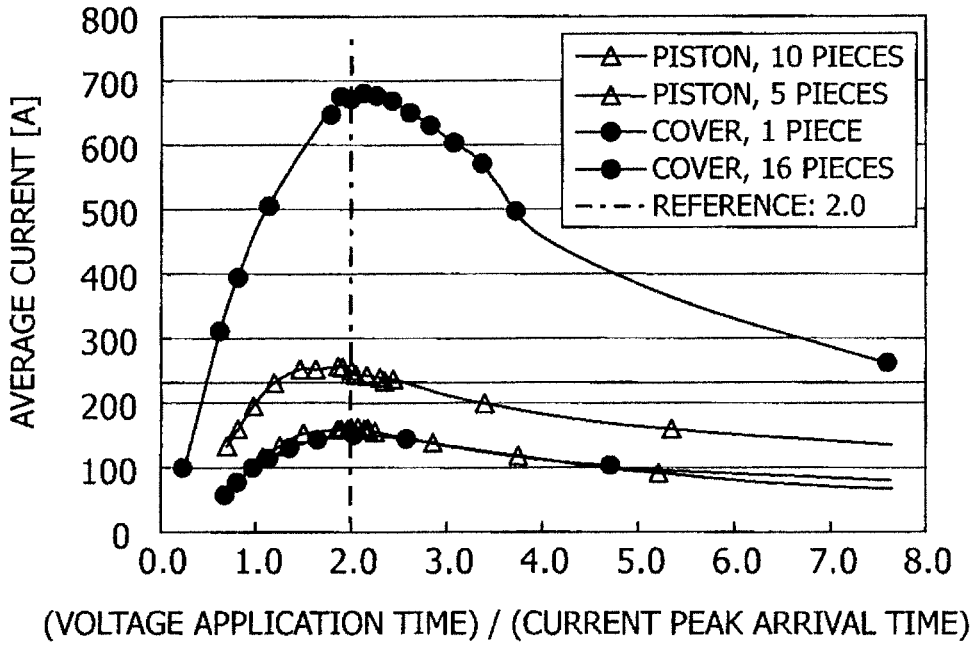
FIG. 6 is a graph showing the relationship between voltage application time/current peak arrival time and average current in the cases in which the treated surface area is different.

On the other hand, FIG. 6 is a graph in which the abscissas represent a value (T/tc) obtained by dividing the positive voltage application time (T) by the peak arrival time (tc). FIG. 6 indicates that regardless of the treated surface area, the average current at the positive voltage application period of one cycle reaches at the maximum at a point at which the positive voltage application time (T) is about two times the peak arrival time (tc).

By the above-described results, it was verified that proper positive voltage application time considering the treatment speed and treatment quality can be selected based on the peak arrival time (tc) regardless to the number of workpieces and the treated surface area.

Figure 7:
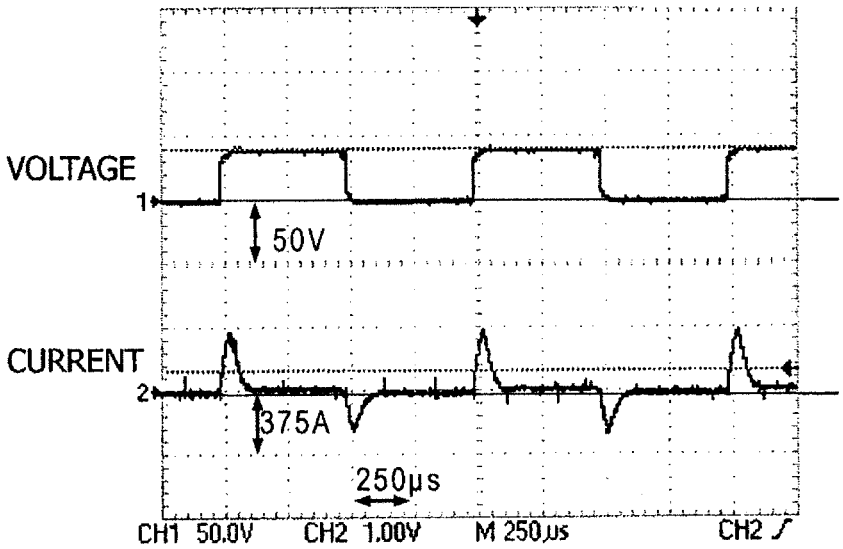
FIG. 7 is a graph showing a current waveform and a voltage waveform in a tentative cycle.

FIGS. 7 to 10 show current waveforms A and voltage waveforms V actually detected by the current detector 44 and the voltage detector 45, respectively, at each positive voltage application time (T) in the above-described experiment. Among these figures, FIG. 7 shows a current waveform (A) and a voltage waveform V in the case in which the period is 1000 μm and the positive voltage application time (T) is 480 μm, corresponding to the anodizing treatment in which the application of positive voltage and the removal of charges are repeated alternately in the tentative cycle. Since the positive voltage application time (T) has a length of about 16 times that of the peak arrival time (tc) of 31 μm of the current waveform, many periods of time for which current scarcely flows are included. Nevertheless, the film thickness obtained by the anodizing treatment for five minutes was 6.0 μm.

Figure 8:
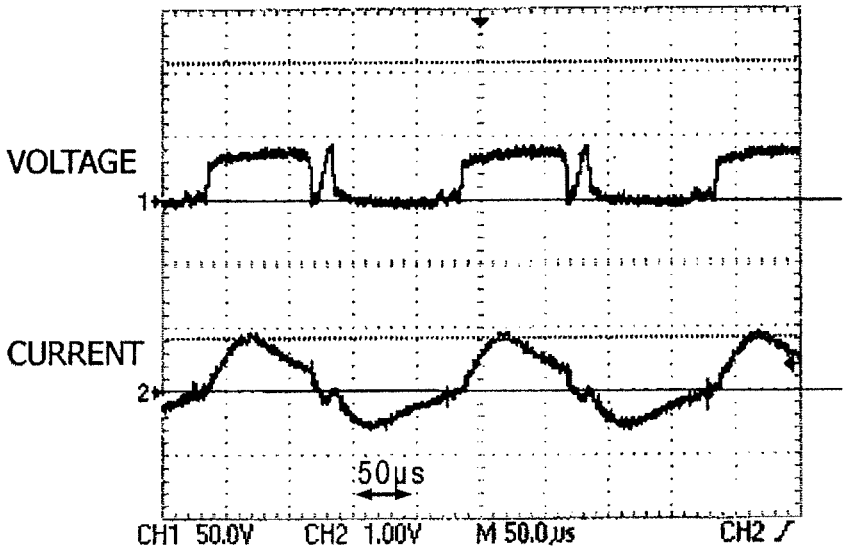
FIG. 8 is a graph showing a current waveform and a voltage waveform in setting in which priority is given to the treatment speed.

FIG. 8 shows a current waveform (A) and a voltage waveform V in the case in which the anodizing treatment was performed by setting the period at 200 μm and the positive voltage application time (T) at 80 μm that is 2.7 times the peak arrival time (31 μm). That is to say, the positive voltage application is finished at 80 μm corresponding to T/tc=2.7, and after an interval of 20 μm, the process shifts to the removal of charges. In the current waveform, a section in which current scarcely flows as found in FIG. 7 does not exist.

The film thickness obtained by the anodizing treatment for five minutes increased to 15.0 μm.

Figure 9:
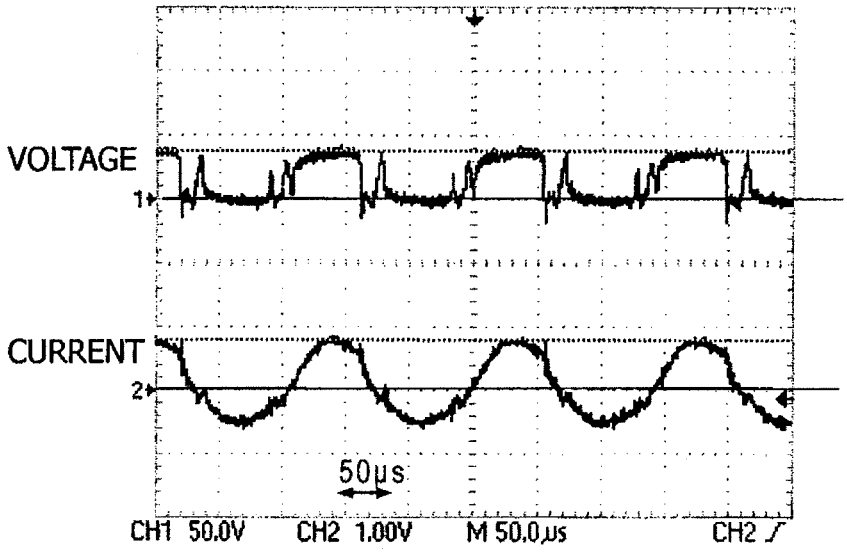
FIG. 9 is a graph showing a current waveform and a voltage waveform in setting in which both of the treatment speed and the treatment quality are secured.

FIG. 9 shows a current waveform (A) and a voltage waveform V in the case in which the anodizing treatment was performed by setting the period at 143 μm and the positive voltage application time (T) at 51 μm that is 1.7 times the peak arrival time. That is to say, although the peak of current waveform has passed, the positive voltage application is stopped at timing of T/tc=1.7 at which a sufficient amount of current is still present, and after an interval of 20 μm, the process shifts to the removal of charges, the waveform having a shape close to a sinusoidal curve. The film thickness obtained by the anodizing treatment for five minutes reached the highest value of 17.0 μm.

Figure 10:
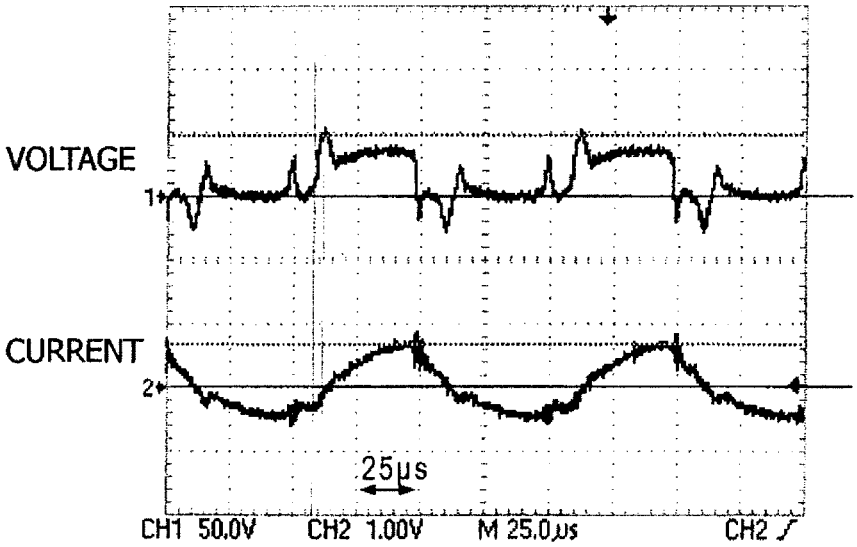
FIG. 10 is a graph showing a current waveform and a voltage waveform in setting in which priority is given to the treatment quality.

FIG. 10 shows a current waveform (A) and a voltage waveform V in the case in which the anodizing treatment was performed by setting the period at 100 μm and the positive voltage application time (T) at 30 μm that is almost equal to the peak arrival time. That is to say, although the positive voltage application is stopped at a point near the peak of current waveform of T/tc=1.0, a film thickness of 9.0 μm is obtained by anodizing treatment for five minutes. Since switching is performed at very short periods, noise is found in the voltage waveform as compared with other examples. However, the current waveform has no great disorder, and the film properties agree with the good experimental results.

Figure 11:
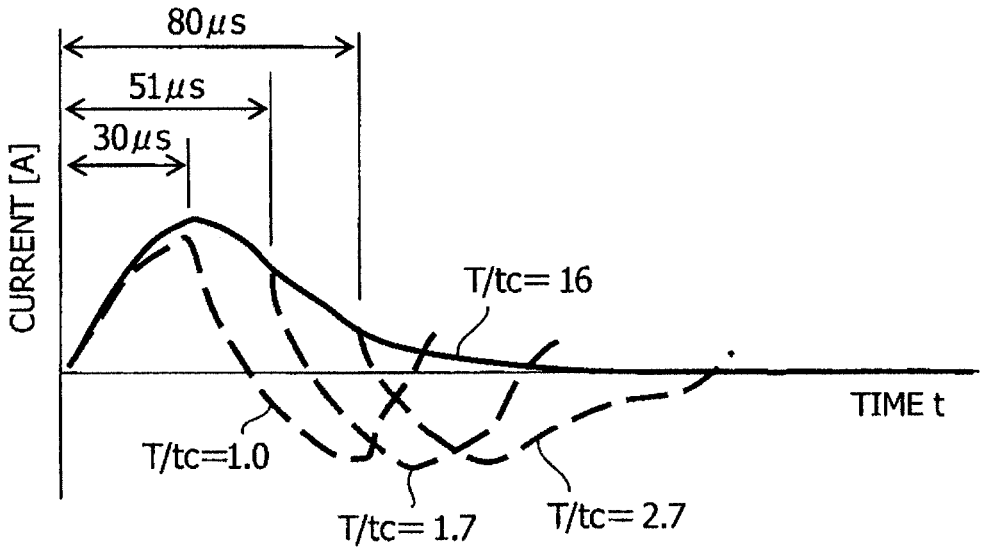
FIG. 11 is a graph showing current waveforms shown in FIGS. 7 to 10, the current waveforms being shown in overlapped form on the same time axis.

FIG. 11 is a graph showing current waveforms shown in FIGS. 7 to 10, the current waveforms being shown in overlapped form on the same time axis. T/tc=1.7 corresponds to setting in which the treatment speed and the treatment quality are balanced, T/tc=1.0 corresponds to setting in which priority is given to the treatment quality, and T/tc=2.7 corresponds to setting in which priority is given to the treatment speed. Typical setting corresponding to each treatment mode of the positive voltage application time (T) based on the peak arrival time (tc) is shown clearly.

The film forming rate attained by the anodizing treatment of the present invention reaches a rate not lower than 13 μm/min for an expanded material and AC material, not lower than 6.0 μm/min for a machined surface of an ADC material containing 7.5% or more Si, and not lower than 3.4 μm/min even for a casting surface. Considering that the film forming rate in the conventional DC anodizing treatment has been not higher than 1.0 μm/min for an expanded material or AC material, and not higher than 0.5 μm/min for an ADC material containing 7.5% or more Si, it can be said that the film forming rate is increased significantly.

Next, to verify the effectiveness in the case in which the above-described process for setting the positive voltage application time (T) based on the peak arrival time (tc) is performed during the slow-up period, an experiment was conducted to examine the relationship between the applied voltage (V) and the current peak arrival time (tc) for six sets of samples n1 to n6 each having a different treated surface area. For the samples n1 to n6, the treated surface area (surface area of one part×number) increases in ascending order of sample number.

Figure 12:
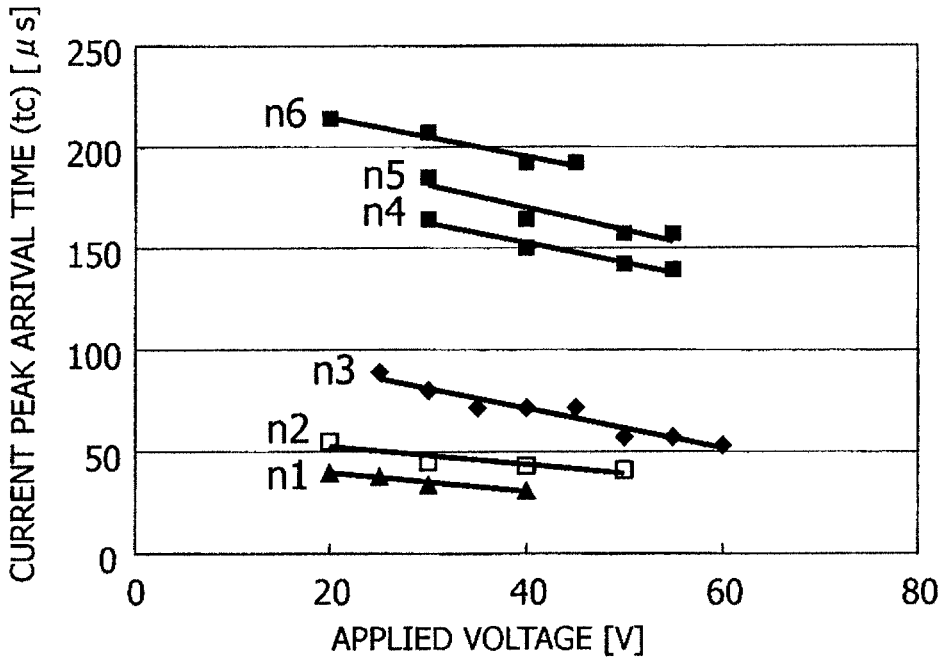
FIG. 12 is a graph showing the relationship between applied voltage and current peak arrival time in the cases in which the workpiece surface area is different.

FIG. 12 is a graph showing the experimental results. By the results, it was verified that with the increase in the applied voltage (V), the peak arrival time (tc) decreases, and the tendency for the peak arrival time (tc) to decrease decreases on the rise side of the applied voltage (V). These curves show that substantially, the peak arrival time (tc) is inversely proportional to the applied voltage (V), and show that the peak arrival time (tc) at the final supplied voltage value can be predicted from the peak arrival time (tc) at a transient supplied voltage value during the slow-up period.

Moreover, the rate of decrease of the peak arrival time (tc) is generally low relative to the rise in the applied voltage (V). For samples n1 and n2 having a relatively small treated surface area, the peak arrival time (tc) scarcely changes at an applied voltage of 30 to 50V. Therefore, in the case in which the treated surface area is relatively small, if the peak arrival time (tc) is determined at the final stage of the slow-up period, for example, at a point at which the transient supplied voltage value reaches about 80% of the final supplied voltage value, proper positive voltage application time considering the treatment speed and the treatment quality can be determined based on the determined value of the peak arrival time (tc).

Also, since the curve of peak arrival time is approximately close to a straight line, if the peak arrival time (tc) is measured at least two times during the slow-up period, peak arrival time (tc3) at the final supplied voltage value (V3) can be determined by collinear approximation from the supplied voltage values (V1, V2) and the peak arrival times (tc1, tc2) at the time of measurement. If the number of times the peak arrival time is measured during the slow-up period is increased, the accuracy of approximation is further enhanced.

If the peak arrival time at the final supplied voltage value can be determined during the slow-up period and the final positive voltage application time (T) considering the treatment speed and the treatment quality can be determined based on the determined value of the peak arrival time, the process can shift to a period corresponding to this positive voltage application time (T) during the slow-up period. In this case, the process shifts from a tentative voltage application period to a normal voltage application period gradually or stepwise, so that the load on the power supply unit can be reduced.

The above is a description of an embodiment of the present invention. The present invention is not limited to the above-described embodiment, and various modifications and changes can be made based on the technical concept of the present invention.

In the above-described embodiment, there has been described the case in which the control point of current waveform is made the peak arrival time (tc), and the positive voltage application time (T) corresponding to each treatment mode is set based on the peak arrival time (tc). However, in place of measurement of the peak arrival time (tc), a threshold value of current is set appropriately and a time at which the threshold value is reached is measured, or a time itself at which the current exceeds the threshold value is measured, by which the positive voltage application time (T) can be set based on the measured time. In this case, for example, the threshold value can be set by a ratio to the peak value of current.

Also, in the above-described embodiment, there has been described the case in which, considering the load on the power supply unit 4, setting is performed so that the positive voltage application time and the film charge removal time due to negative voltage application are equal to each other. However, the positive voltage application time and the charge removal time in one cycle may be different from each other. Furthermore, the case in which the negative voltage at the film charge removal time is zero, that is, the case in which the charge removal is not accomplished positively is also assumed. In this case, the effect of removing electric charges decreases, so that a negative voltage is preferably applied at the film charge removal time.

The invention claimed is:

1. A method of anodizing a workpiece made of aluminum or aluminum alloy, the method comprising:

immersing the workpiece in an electrolytic solution in which a cathode is arranged;

performing a tentative treatment in which an application of positive voltage and removal of charges by application of a negative voltage are repeated alternately, between the workpiece and the cathode, in a tentative cycle;

increasing the starting positive voltage to a set positive voltage continuously or stepwise;

measuring a peak arrival time of a current waveform at the positive voltage application period in the tentative cycle during the increasing of the positive voltage;

determining an optimum positive voltage application time in a range of 0.6 to 3 times the peak arrival time during the increasing of the positive voltage; and performing a conclusive treatment in which the application of the positive voltage and the removal of charges by the application of the negative voltage are repeated in an optimum cycle corresponding to the optimum positive voltage application time, whereby an actually detected current waveform is maintained as continuous curves, to form an anodized film on the surface of the workpiece.

2. The method according to claim 1, wherein the determining an optimum positive voltage application time step further comprises predicting the peak arrival time in the state in which the voltage is increased to the set positive voltage based on the peak arrival time measured during the increasing of the positive voltage value at the time of the measurement.

3. The method according to claim 1, wherein the peak arrival time of the current waveform is provided as a time at which the current value reaches a predetermined threshold value before or after the peak of current waveform is reached.

4. The method according to claim 1, wherein the optimum positive voltage application time is determined in the range of 1 to 3 times the peak arrival time.

5. The method according to claim 1, wherein the optimum positive voltage application time is determined in the range of 0.6 to 1.5 times the peak arrival time, and after determining the optimum positive voltage application time, a supplied voltage is increased in the range in which an average current value at the determined optimum positive voltage application time does not exceed the maximum average current value.

6. The method according to claim 1, wherein the optimum positive voltage application time is determined in the range of 0.6 to 1.5 times the peak arrival time, and after determining the optimum positive voltage application time, a supplied voltage is increased in the range in which an average current value at the determined optimum positive voltage application time does not exceed the average current value at the positive voltage application time that is two times the peak arrival time.

* * * * *